US007138362B2

(12) United States Patent
Abe et al.

(10) Patent No.: US 7,138,362 B2
(45) Date of Patent: Nov. 21, 2006

(54) WASHING LIQUID COMPOSITION FOR SEMICONDUCTOR SUBSTRATE

(75) Inventors: Yumiko Abe, Saitama (JP); Norio Ishikawa, Saitama (JP); Hidemitsu Aoki, Kanagawa (JP); Hiroaki Tomimori, Kanagawa (JP); Yoshiko Kasama, Kanagawa (JP)

(73) Assignees: Kanto Kagaku Kabushiki Kaisha, Tokyo (JP); NEC Electronics Corporation, Kanagawa (JP)

( * ) Notice: Subject to any disclaimer, the term of this patent is extended or adjusted under 35 U.S.C. 154(b) by 126 days.

(21) Appl. No.: 10/369,877

(22) Filed: Feb. 19, 2003

(65) Prior Publication Data

US 2003/0171233 A1 Sep. 11, 2003

(30) Foreign Application Priority Data

Feb. 19, 2002 (JP) ..... 2002-041393

(51) Int. Cl.
*C11D 7/50* (2006.01)

(52) U.S. Cl. ..... 510/175; 510/176; 134/1.3

(58) Field of Classification Search ..... 510/175, 510/176; 134/1.3
See application file for complete search history.

(56) References Cited

U.S. PATENT DOCUMENTS

| | | | | |
|---|---|---|---|---|
| 6,080,709 | A | 6/2000 | Ishikawa et al. | 510/175 |
| 6,143,705 | A | 11/2000 | Kakizawa et al. | 510/175 |
| 6,147,002 | A * | 11/2000 | Kneer | 438/692 |
| 6,395,693 | B1 * | 5/2002 | Wang | 510/175 |
| 6,410,494 | B1 * | 6/2002 | Kakizawa et al. | 510/175 |
| 6,423,148 | B1 * | 7/2002 | Aoki | 134/3 |
| 6,444,583 | B1 * | 9/2002 | Aoki | 438/692 |
| 6,498,131 | B1 * | 12/2002 | Small et al. | 510/175 |

FOREIGN PATENT DOCUMENTS

| | | |
|---|---|---|
| EP | 0 986 096 A2 | 3/2000 |
| EP | 1 047 121 A1 | 10/2000 |
| EP | 1 187 225 A2 | 3/2002 |
| JP | 10-72594 | 3/1998 |
| JP | 11-131093 | 5/1999 |
| JP | 2001-007071 | 12/2001 |
| WO | WO 01/24242 A1 | 4/2001 |

* cited by examiner

*Primary Examiner*—Gregory Webb
(74) *Attorney, Agent, or Firm*—Licata & Tyrrell P.C.

(57) ABSTRACT

There is provided a washing liquid composition for a semiconductor substrate having a contact angle between the surface thereof and water dropped thereon of at least 70 degrees, the washing liquid composition including an aliphatic polycarboxylic acid and a surfactant, and the washing liquid composition having a contact angle of at most 50 degrees when dropped on the semiconductor substrate. It is thereby possible to effectively remove particles and metals on the surface of a hydrophobic substrate without corroding it.

12 Claims, No Drawings

WASHING LIQUID COMPOSITION FOR SEMICONDUCTOR SUBSTRATE

This application claims the benefit of priority of Japanese Serial No. 2002-41393 filed Feb. 19, 2002.

BACKGROUND OF THE INVENTION

1. Technical Field to which the Invention Pertains

The present invention relates to a washing liquid and, in particular, it relates to a washing liquid for removing particulate contaminants adsorbed on the surface of a hydrophobic substrate such as bare silicon or a low-permittivity (Low-K) film.

Furthermore, the present invention relates to a washing liquid used in the washing of, in particular, a substrate subsequent to chemical-mechanical polishing (hereinafter, called CMP) in a semiconductor production process.

2. Prior Art

Accompanying the increasing integration of ICs, there is a demand for strict contamination control since trace amounts of impurities greatly influence the performance and yield of a device. That is, strict control of particles and metals on a substrate is required, and various types of washing liquids are therefore used in each of the semiconductor production processes.

With regard to washing liquids generally used for semiconductor substrates, there are sulfuric acid-aqueous hydrogen peroxide solution, ammonia water-aqueous hydrogen peroxide solution-water (SC-1), hydrochloric acid-aqueous hydrogen peroxide solution-water (SC-2), dilute hydrofluoric acid, etc., and the washing liquids are used singly or in combination according to the intended purpose. In recent years, CMP technique has been introduced into such semiconductor production processes as planarization of an insulating film, planarization of a via-hole, and damascene wiring. Generally, CMP is a technique in which a film is planarized by pressing a wafer against a cloth called a buff and rotating it while supplying a slurry, which is a mixture of abrasive particles, a chemical agent and water, so that an interlayer insulating film material or a metal film material is polished by a combination of chemical and physical actions. Because of this, the CMP-treated substrate is contaminated with large amounts of particles and metals including alumina particles and silica particles used in the abrasive particles. It is therefore necessary to employ cleaning to completely remove these contaminants prior to the following process. As a post-CMP washing liquid, an alkali aqueous solution such as ammonia water is conventionally used for removing particles. For removing metallic contaminants, techniques using an aqueous solution of organic acid and a complexing agent have been proposed in JP, A, 10-72594 and JP, A, 11-131093. As a technique for simultaneously removing metallic contaminants and particulate contaminants, a washing aqueous liquid in which an organic acid and a surfactant are combined has been proposed in JP, A, 2001-7071.

One of the fields in which CMP is applied is the planarization of an interlayer insulating film. The interlayer insulating film is mainly formed from an $SiO_2$-based film, and since in this technique a metallic material is not exposed, conventionally, washing with an aqueous solution of ammonium fluoride or an aqueous solution of the organic acid described above can be employed. In recent years Cu has been used as a wiring material in order to increase the response speed of semiconductor devices, and at the same time there have been attempts to use as the interlayer insulating film an organic film such as an aromatic aryl polymer, a siloxane film such as MSQ (Methyl Silsesquioxane) or HSQ (Hydrogen Silsesquioxane), an SiOC film, a porous silica film, etc., which have lower permittivity than that of the conventional $SiO_2$-based film. These novel materials cannot be washed satisfactorily by using conventional washing liquids as they are. Furthermore, there are cases, not only in the planarization of interlayer insulating films, but also in the planarization of Cu wiring, which is another field of application of CMP, in which the above-mentioned low permittivity film is exposed due to overpolishing, and since in these cases also conventional washing liquids cannot be used satisfactorily for washing, there is a desire for a washing liquid that is effective for these semiconductor substrates.

SUMMARY OF THE INVENTION

It is therefore an object of the present invention to solve the above-mentioned problems and provide a washing liquid that can effectively remove particles and metals from the surface of an organic film such as an aromatic aryl polymer, a siloxane film such as MSQ (Methyl Silsesquioxane) or HSQ (Hydrogen Silsesquioxane), an SiOC film, a porous silica film, etc., which have low permittivity, without corroding them.

As a result of an intensive investigation by the present inventors in order to solve the above-mentioned problems it has been found that when a conventional aqueous washing liquid used for a hydrophilic $SiO_2$-based film is used as it is for a low permittivity (Low-K) film, the surface wettability is poor, and washing cannot be carried out satisfactorily. When a specific surfactant is added to an aqueous solution of aliphatic carboxylic acid such as oxalic acid, which does not damage the low permittivity film and does not corrode the metallic material, it has been found that, surprisingly, the wettability is improved and adsorbed particles can be washed away effectively, and the present invention has thus been accomplished.

That is, the present invention relates to a washing liquid composition for a semiconductor substrate having a contact angle between the surface thereof and water dropped thereon of at least 70 degrees, the washing liquid composition including an aliphatic polycarboxylic acid and a surfactant, and the washing liquid composition having a contact angle of at most 50 degrees when dropped on the semiconductor substrate.

Furthermore, the present invention relates to the above-mentioned washing liquid composition wherein the surfactant is one type or two or more types chosen from the group consisting of a polyoxyalkylene alkyl ether type nonionic surfactant, a polyoxyalkylene alkylphenyl ether type nonionic surfactant, an alkylbenzenesulfonic acid type anionic surfactant and a salt thereof, an alkylphosphate ester type anionic surfactant, a polyoxyalkylene alkylphenyl ether sulfonic acid type anionic surfactant and a salt thereof, a polyoxyalkylene alkyl ether sulfonic acid type anionic surfactant and a salt thereof, and a fluorosurfactant.

Moreover, the present invention relates to a washing liquid composition for a semiconductor substrate having a low permittivity (Low-K) film, the washing liquid composition including an aliphatic polycarboxylic acid and one type or two or more types of surfactant chosen from the group consisting of a polyoxyalkylene alkyl ether type nonionic surfactant, a polyoxyalkylene alkylphenyl ether type nonionic surfactant, an alkylbenzenesulfonic acid type anionic surfactant and a salt thereof, an alkylphosphate ester type anionic surfactant, a polyoxyalkylene alkylphenyl ether sulfonic acid type anionic surfactant and a salt thereof, a polyoxyalkylene alkyl ether sulfonic acid type anionic surfactant and a salt thereof, and a fluorosurfactant.

Furthermore, the present invention relates to the above-mentioned washing liquid composition wherein the contact angle is at most 50 degrees when dropped on the semiconductor substrate.

Moreover, the present invention relates to the above-mentioned washing liquid composition wherein the aliphatic polycarboxylic acid is one type or two or more types chosen from the group consisting of oxalic acid, malonic acid, malic acid, tartaric acid, and citric acid.

Furthermore, the present invention relates to the above-mentioned washing liquid composition wherein the aliphatic polycarboxylic acid is included at 0.01 to 30 wt % in the washing liquid composition.

Moreover, the present invention relates to the washing liquid composition wherein the surfactant is included at 0.0001 to 10 wt % in the washing liquid composition.

Since the aliphatic polycarboxylic acid has an ability to remove metallic impurities satisfactorily without corroding a metal on a semiconductor substrate, metallic contaminants can be removed. However, it has poor wettability toward particles adsorbed on the surface of a hydrophobic substrate, and it is conceivable that particulate contaminants cannot be removed satisfactorily. In the washing liquid composition of the present invention, the aliphatic polycarboxylic acid is therefore combined with a specific surfactant, thus greatly reducing the contact angle with the surface of a hydrophobic substrate and thereby enabling good wettability to be exhibited, and as a result removal of particles can be greatly improved. That is, both metallic contaminants and particulate contaminants can be completely removed.

Furthermore, the washing liquid composition of the present invention damages neither the Low-K film nor the metal and, moreover, aggregation can be suppressed without altering the solution properties.

MODES FOR CARRYING OUT THE INVENTION

The washing liquid composition of the present invention is a washing liquid having excellent washing performance for particulate contaminants and metallic contaminants on a hydrophobic substrate such as, for example, bare silicon or a low permittivity (Low-K) film.

The hydrophobic substrate referred to here, for which the washing liquid composition of the present invention is used, means one in which the contact angle between the surface thereof and water dropped thereon is at least 70 degrees.

The Low-K film referred to here mainly means a film having a low permittivity of 4.0 or less, and examples thereof include an organic film such as an aromatic aryl polymer, a siloxane film such as MSQ (Methyl Silsesquioxane) or HSQ (Hydrogen Silsesquioxane), an SiOC film, and a porous silica film.

The washing liquid composition of the present invention is prepared so that the contact angle between a substrate surface and the washing liquid composition dropped thereon is at most 50 degrees. In particular, it is preferably at most 30 degrees when taking into consideration particle removal. The washing liquid is prepared by appropriately combining an aliphatic polycarboxylic acid and a surfactant shown below while taking into consideration the properties of the substrate used, etc.

More specifically, the washing liquid composition of the present invention is an aqueous solution which is prepared by adding an aliphatic polycarboxylic acid and a surfactant to water as a solvent.

The aliphatic polycarboxylic acid used in the present invention mainly removes metallic contaminants, and examples of the aliphatic polycarboxylic acid include dicarboxylic acids such as oxalic acid and malonic acid and oxypolycarboxylic acids such as tartaric acid, malic acid, and citric acid. Oxalic acid in particular has a high ability to remove metallic impurities and is preferable as the aliphatic polycarboxylic acid used in the present invention.

The concentration of the aliphatic polycarboxylic acid in the washing liquid is preferably 0.01 to 30 wt %, and particularly preferably 0.03 to 10 wt %.

The above-mentioned concentration is appropriately determined within a range in which a satisfactory washing effect can be exhibited, and an effect can be expected in line with the concentration while taking into consideration the solubility and precipitation of crystals.

With regard to the surfactants used in the present invention, there can be cited (1) polyoxyalkylene alkyl ether type and (2) polyoxyalkylene alkylphenyl ether type nonionic surfactants.

With regard to (1), Newcol 1310 and 2308-HE (both manufactured by Nippon Nyukazai Co., Ltd.), the Nonion K and Dispernol TOC series (both manufactured by NOF Corporation), the Pegnol series (manufactured by Toho Chemical Industry Co., Ltd.), the Leocol, Leox, and Dobanox series (all manufactured by Lion Corporation), the Emulgen series (manufactured by Kao Corporation), the NIKKOL BL, BT, NP, and OP series (all manufactured by Nikko Chemicals Co., Ltd.), the Noigen LP and ET series (both manufactured by Dai-ichi Kogyo Seiyaku Co., Ltd.), Sannonic FD-100,the Emulmin and Naloacty N series (all manufactured by Sanyo Chemical Industries, Ltd.), etc. are commercially available under the above-mentioned product names.

With regard to (2), Newcol 565, 566FH, 864,and 710 (all manufactured by Nippon Nyukazai Co., Ltd.), the Nonion NS and Nonion HS series (both manufactured by NOF Corporation), the Nonal series (manufactured by Toho Chemical Industry Co., Ltd.), the Liponox series (manufactured by Lion Corporation), the Nonipol and Octapol series (both manufactured by Sanyo Chemical Industries, Ltd.), the Noigen EA series (manufactured by Dai-ichi Kogyo Seiyaku Co., Ltd.), etc. are commercially available under the above-mentioned product names.

In addition there can be cited anionic surfactants, including (3) alkylbenzenesulfonic acids and salts thereof, (4) polyoxyethylene alkyl phosphate esters, (5) polyoxyalkylene alkylphenyl ether sulfonic acids and salts thereof, (6) polyoxyalkylene alkyl ether sulfonic acids and salts thereof, etc.

With regard to (3), Newcol 210, 211-MB, and 220L (manufactured by Nippon Nyukazai Co., Ltd.), Newlex R (manufactured by NOF Corporation), the Lipon series (manufactured by Lion Corporation), the Taycapower series (manufactured by Tayca Corporation), the Neopelex series (manufactured by Kao Corporation), the Neogen series (manufactured by Dai-ichi Kogyo Seiyaku Co., Ltd.), etc. are commercially available under the above-mentioned product names.

With regard to (4), Phosphanol RS-710 and 610 (manufactured by Toho Chemical Industry Co., Ltd.), the Plysurf series (manufactured by Dai-ichi Kogyo Seiyaku Co., Ltd.), etc. are commercially available under the above-mentioned product names.

With regard to (5), Newcol 560SF, SN, 707SF, and SN (all manufactured by Nippon Nyukazai Co., Ltd.), the Eleminol series (manufactured by Sanyo Chemical Industries, Ltd.), the Sunol NP series (manufactured by Lion Corporation), the Hitenol series (manufactured by Dai-ichi Kogyo Seiyaku Co., Ltd.), NIKKOL SNP-4N and 4T (manufactured by Nikko Chemicals Co., Ltd.), etc. are commercially available under the above-mentioned product names.

With regard to (6), Newcol 1305SN (manufactured by Nippon Nyukazai Co., Ltd.), the Persoft and Nissanabanel S series (both manufactured by NOF Corporation), the NIKKOL SBL and NES series (both manufactured by Nikko Chemicals Co., Ltd.), the Hitenol series (manufactured by Dai-ichi Kogyo Seiyaku Co., Ltd.), etc. are commercially available under the above-mentioned product names.

In addition, fluorosurfactants can be cited, and examples thereof include the product named Surflon S-131 (Asahi Glass Co., Ltd.), which is of a perfluoroalkyl betaine type, the products named Surflon S-113 and 121 (Asahi Glass Co., Ltd.), Unidyne DS-101 (Daikin Industries, Ltd.) and Eftop EF-201 (Mitsubishi Chemical Corporation), which are of a perfluoroalkylcarboxylic acid type, and the product named Ftergent 251 (manufactured by Neos), which is of a perfluoroalkyl nonionic type.

The surfactants (1) to (6) can improve the wettability toward a hydrophobic substrate when used singly, but the combined use thereof with the above-mentioned specific fluorosurfactant can improve the wettability to a greater extent, which is preferable.

A material in the form of a metal salt such as a sodium salt is treated with an ion-exchange resin, etc. to convert the metal such as sodium into H or $NH_4$, and it can then be used.

The surfactant concentration is preferably 0.0001 to 10 wt %, and particularly preferably 0.001 to 0.1 wt %, when taking into consideration the effect in removing particles and the concentration dependence of the effect.

EXAMPLES

The present invention is explained in detail below by reference to Examples of the present invention together with Comparative Examples, but the present invention is not limited by these examples.

The washing liquid compositions shown in Tables 1, 2 and 3 were prepared by using water as a solvent and the measurement of a contact angle and evaluation of particle removal performance and metallic impurity removal performance were carried out.

Contact Angle with Surface of Hydrophobic Substrate 1: Bare Silicon

The contact angle when dropped on the surface of a bare silicon substrate was measured using a contact angle measurement instrument, the wettability toward the substrate was evaluated, and the results are given in Table 1.

TABLE 1

| | Polycarboxylic acid (wt %) | | Surfactant (wt %) | | Contact angle (°) |
|---|---|---|---|---|---|
| Comp. Ex. 1 | Oxalic acid | 0.068 | None | | 71.0 |
| Comp. Ex. 2 | | | n-Tetradecylammonium chloride | 0.01 | 56.1 |
| Comp. Ex. 3 | | | PolyT A-550 | 0.01 | 63.5 |
| Comp. Ex. 4 | | | Demol AS | 0.01 | 65.5 |
| Example 1 | | | Newcol 707SF | 0.01 | 13.9 |
| Example 2 | | | Noigen ET-116C | 0.01 | 14.4 |
| Example 3 | | | Taycapawer L-122 | 0.01 | 17.8 |
| Example 4 | Oxalic acid | 0.34 | Hitenol A-10 | 0.1 | 21.3 |
| Example 5 | Oxalic acid | 3.4 | Noigen ET-116C | 0.1 | 10.1 |
| Example 6 | | | Newcol 707SF | 0.1 | 9.8 |

PolyT A-550: Carboxylic acid polymer (manufactured by Kao Corporation)

Demol AS: Condensate between ammonium naphthalenesulfonate and formaldehyde (manufactured by Kao Corporation)

Newcol 707SF: Polyoxyalkylene alkylphenyl ether sulfonate salt (manufactured by Nippon Nyukazai Co., Ltd.)

Noigen ET-116C: Polyoxyalkylene alkyl ether (manufactured by Dai-ichi Kogyo Seiyaku Co., Ltd.)

Taycapower L-122: Dodecylbenzenesulfonic acid (manufactured by Tayca Corporation)

Hitenol A-10: Polyoxyalkylene alkyl ether sulfonate salt (manufactured by Dai-ichi Kogyo Seiyaku Co., Ltd.)

Contact Angle with Surface of Hydrophobic Substrate 2: SiLK Organic Film

The contact angle when dropped on the surface of SiLK (manufactured by The Dow Chemical Company), which is an organic Low-K film, was measured using a contact angle measurement instrument, the wettability toward the substrate was evaluated, and the results are given in Table 2.

TABLE 2

| | Polycarboxylic acid (wt %) | | Surfactant (wt %) | | Contact angle (°) |
|---|---|---|---|---|---|
| Comp. Ex. 5 | Oxalic acid | 0.34 | None | | 82.1 |
| Comp. Ex. 6 | | | Demol AS | 0.01 | 61.6 |
| Comp. Ex. 7 | | | PolyT A-550 | 0.01 | 79.5 |
| Comp. Ex. 8 | Malonic acid | 0.068 | None | | 82.0 |
| Example 7 | Oxalic acid | 0.34 | Newcol 1305SN | 0.01 | 28.0 |
| Example 8 | | | Newcol 1310 | 0.01 | 14.5 |
| Example 9 | | | Taycapower L-122 | 0.01 | 21.7 |
| Example 10 | | | Phosphanol RS710 | 0.1 | 25.6 |
| Example 11 | Oxalic acid | 3.4 | Noigen ET-116C | 0.1 | 15.6 |
| Example 12 | | | Ftergent 100 | 0.1 | 22.0 |
| Example 13 | Malonic acid | 0.068 | Noigen ET-116C | 0.04 | 8.9 |

Newcol 1305SN: Polyoxyalkylene alkyl ether sulfonic acid (manufactured by Nippon Nyukazai Co., Ltd.)

Newcol 1310: Polyoxyalkylene alkyl ether (manufactured by Nippon Nyukazai Co., Ltd.)

Phosphanol RS-710: Polyoxyethylene alkylphosphate ester (manufactured by Toho Chemical Industry Co., Ltd.)

Ftergent 100: Perfluoroalkyl sulfonate salt (manufactured by Neos)

Contact Angle with Surface of Hydrophobic Substrate 3: Low-K Film having SiOC as Component The contact angle when dropped on the surface of a Low-K film having SiOC as a component was measured using a contact angle measurement instrument, the wettability toward the substrate was evaluated, and the results are given in Table 3.

TABLE 3

| | Polycarboxylic acid (wt %) | | Surfactant (wt %) | | Contact angle (°) |
|---|---|---|---|---|---|
| Comp. Ex. 9 | Oxalic acid | 0.064 | None | | 95.1 |
| Comp. Ex. 10 | | | Demol AS | 0.05 | 84.4 |
| Comp. Ex. 11 | Malonic acid | 0.068 | None | | 95.6 |
| Example 14 | Oxalic acid | 0.064 | Newcol 1310 | 0.05 | 35.5 |
| Example 15 | | | Phosphanol RS710 | 0.04 | 48.8 |
| Example 16 | | | Noigen ET-116C | 0.1 | 35.5 |
| Example 17 | | | Newcol 1310 | 0.04 | 18.4 |
| | | | Surflon S-113 | 0.01 | |
| Example 18 | | | Newcol 1310 | 1.00 | 26.9 |
| | | | Perfluoroalkylcarboxylic acid | 0.02 | |
| Example 19 | | | Noigen ET-116C | 0.1 | 14.5 |
| | | | Surflon S-113 | 0.01 | |
| Example 20 | | | Noigen ET-116C | 0.01 | 12.3 |
| | | | Eftop EF-201 | 0.02 | |
| Example 21 | | | Phosphanol RS710 | 0.04 | 24.6 |
| | | | Surflon S-113 | 0.01 | |
| Example 22 | Malonic acid | 0.068 | Noigen ET-116C | 0.04 | 26.3 |
| | | | Eftop EF-201 | 0.01 | |

Surflon S-113: Perfluoroalkylcarboxylate salt (manufactured by Asahi Glass Co., Ltd.)

Eftop EF-201: Perfluoroalkylcarboxylate salt (manufactured by Mitsubishi Chemical Corporation)

Particle Removal Performance

A bare silicon wafer and a wafer on which a Low-K film having SiOC as a component was formed were immersed in a slurry containing silica particles, the wafers contaminated with the silica particles were washed, and the particle removal performance was evaluated.

(1) Bare Silicon Wafer

Slurry immersion time: 30 sec.

Washing conditions: 25° C., 20 to 60 sec. (washing with brush)

TABLE 4

| | Number of particles (count/wafer) | | |
|---|---|---|---|
| | 20 sec | 40 | 60 |
| Comp. Ex. 4 | 4900 | 1980 | 1300 |
| Example 5 | 2400 | 420 | 170 |

(2) Low-K Film having SiOC as Component

Slurry immersion time: 30 sec. Washing conditions: 25° C., 60 sec. (washing with brush)

TABLE 5

| | Number of particles (count/wafer) |
|---|---|
| Comp. Ex. 9 | 10000 or more |
| Example 16 | 2902 |
| Example 20 | 280 |

Metallic Impurity Removal Performance

A wafer with a naturally oxidized film contaminated with Cu was washed, and the Cu removal performance was examined.

Amount of Cu contaminant: $8\times10^{12}$ atoms/cm$^2$

Washing: 25° C., 3 min. (immersion method)

TABLE 6

| | Polycarboxylic acid(wt %) | | Surfactant (wt %) | | Cu concentration |
|---|---|---|---|---|---|
| Comp. Ex. 11 | Oxalic acid | 0.064 | None | | ND |
| Comp. Ex. 10 | | | Demol AS | 0.05 | ND |
| Example 16 | | | Noigen ET-116C | 0.1 | ND |

ND: $3 \times 10^{10}$ atoms/cm$^2$

Effects of the Invention

Since the washing liquid composition of the present invention greatly reduces the contact angle and has good wettability even on the surface of a hydrophobic substrate, particles and metals adsorbed on the surface can be removed well.

What is claimed is:

1. A washing liquid composition for a semiconductor substrate having a contact angle between the surface thereof and water dropped thereon of at least 70 degrees, the washing liquid composition consisting of:

an aliphatic polycarboxylic acid;

one type or two or more types of surfactant selected from the group consisting of a polyoxyalkylene alkyl ether type nonionic surfactant, a polyoxyalkylene alkylphenyl ether type nonionic surfactant, a polyoxyethylene alkyl phosphate ester type anionic surfactant, and a fluorosurfactant; and water;

wherein the washing liquid composition has a contact angle of at most 50 degrees when dropped on the semiconductor substrate.

2. A washing liquid composition for a semiconducter substrate having a low permittivity (Low-K) film, the washing liquid composition consisting of:

an aliphatic polycarboxylic acid;

one type or two or more types of surfactant chosen from the group consisting of a polyoxyalkylene alkylphenyl ether type nonionic surfactant, a polyoxyethylene alkyl phosphate ester type anionic surfactant, and a fluorosurfactant; and water.

3. The washing liquid composition according to claim 2 wherein the contact angle is at most 50 degrees when dropped on the semiconducter substrate.

4. The washing liquid composition according to claim 1 or 2 wherein the aliphatic polycarboxylic acid is one type or two or more types chosen from the group consisting of oxalic acid, malonic acid, malic acid, tartaric acid, and citric acid.

5. The washing liquid composition according to claim 1 or 2 wherein the aliphatic polycarboxylic acid is included at 0.01 to 30% in the washing liquid composition.

6. The washing liquid composition according to claim 1 or 2 wherein the surfactant is included at 0.0001 to 10% in the washing liquid composition.

7. A method for washing a semiconducter substrate having a low permittivity (Low-K) film to remove particulate contaminates and metallic contaminates from the surface thereof, said method comprising applying to the semiconducter substrate having a low permittivity (Low-K) film a washing liquid composition comprising:

an aliphatic polycarboxylic acid; and one type or two or more types of surfactant chosen from the group consisting of a polyoxyalkylene alkyl ether type nonionic surfactant, a polyoxyalkylene alkylphenyl ether type nonionic surfactant, an alkylbenzenesulfonic acid type anionic surfactant and a salt thereof, a polyoxyethylene alkyl phosphate ester type anionic surfactant, a polyoxyalkylene alkylphenyl ether sulfonic acid type anionic surfactant and a salt thereof, a polyoxyalkylene alkyl ether sulfonic acid type anionic surfactant and a salt thereof, and a fluorosurfactant, so that particulate contaminates and metallic contaminates are removed.

8. The method according to claim 7, wherein particulate contaminants and metallic contaminants are removed from the surface of the substrate subsequent to chemical-mechanical polishing.

9. A method for washing a semiconductor substrate having a contact angle between the surface thereof and water dropped thereon of at least 70 degrees to remove particulate contaminants and metallic contaminants from said surface, said method comprising applying to the semiconductor substrate having a contact angle between the surface thereof and water dropped thereon of at least 70 degrees a washing liquid composition comprising:

an aliphatic polycarboxylic acid; and a surfactant; and having a contact angle of at most 50 degrees when dropped on the semiconductor substrate, so that particulate, contaminants and metallic contaminants are removed.

10. The method according to claim 9, wherein particulate contaminants and metallic contaminants are removed from the surface of the substrate subsequent to chemical-mechanical polishing.

11. A washing liquid composition for a semiconductor substrate having a contact angle between the surface thereof and water dropped thereon of at least 70 degrees, the washing liquid composition consisting of:

an aliphatic polycarboxylic acid;

one type or two or more types of surfactant chosen from the group consisting of a polyoxyalkylene alkyl ether type nonionic surfactant, a polyoxyalkylene alkylphenyl ether type nonionic surfactant, a polyoxyethylene alkyl phosphate ester type anionic surfactant, and a fluorosurfactant;

one type or two or more types of surfactant chosen from the group consisting of an alkylbenzenesulfonic acid type anionic surfactant and a salt thereof, a polyoxyalkylene alkylphenyl ether sulfonic acid type anionic surfactant and a salt thereof, and a polyoxyalkylene alkyl ether sulfonic acid type anionic surfactant and a salt thereof; and water;

wherein the washing liquid composition has a contact angle of at most 50 degrees when dropped on the semiconductor substrate.

12. A washing liquid composition for a semiconductor substrate having a low permittivity (Low-K) film, the washing liquid composition consisting of:

an aliphatic polycarboxylic acid;

one type or two or more types of surfactant chosen from the group consisting of a polyoxyalkylene alkyl ether type nonionic surfactant, a polyoxyalkylene alkylphenyl ether type nonionic surfactant, a polyoxyethylene alkyl phosphate ester type anionic surfactant, and a fluorosurfactant;

one type or two or more types of surfactant chosen from the group consisting of an alkylbenzenesulfonic acid type anionic surfactant and a salt thereof, a polyoxyalkylene alkylphenyl ether sulfonic acid type anionic surfactant and a salt thereof, and a polyoxyalkylene alkyl ether sulfonic acid type anionic surfactant and a salt thereof; and water.

* * * * *